US011220914B1

(12) United States Patent
Thompson

(10) Patent No.: US 11,220,914 B1
(45) Date of Patent: Jan. 11, 2022

(54) CAST COMPONENT INCLUDING PASSAGE HAVING SURFACE ANTI-FRECKLING ELEMENT IN TURN PORTION THEREOF, AND RELATED REMOVABLE CORE AND METHOD

(71) Applicant: General Electric Company, Schenectady, NY (US)

(72) Inventor: Anthony Mark Thompson, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 19 days.

(21) Appl. No.: 17/029,161

(22) Filed: Sep. 23, 2020

(51) Int. Cl.
*F01D 5/18* (2006.01)

(52) U.S. Cl.
CPC ..... *F01D 5/18* (2013.01); *F05D 2220/30* (2013.01); *F05D 2230/21* (2013.01); *F05D 2260/20* (2013.01); *F05D 2300/175* (2013.01)

(58) Field of Classification Search
None
See application file for complete search history.

(56) References Cited

U.S. PATENT DOCUMENTS 4,582,548 A * 4/1986 Harris ..... C22C 19/057 148/404
5,464,322 A * 11/1995 Cunha ..... F01D 5/187 415/115
9,228,439 B2 * 1/2016 Pointon ..... F01D 5/18
10,718,219 B2 * 7/2020 Meier ..... F01D 5/081
2014/0093390 A1 * 4/2014 Pointon ..... F01D 5/18 416/97 R
2018/0051571 A1 * 2/2018 Bunker ..... F04D 29/324
2019/0178089 A1 * 6/2019 Meier ..... F01D 5/3007

OTHER PUBLICATIONS

Related Chinese Patent Application, 202111035534.4, filed Sep. 3, 2021.
Related EP Patent Application, 21196168.5, filed Sep. 10, 2021.

* cited by examiner

*Primary Examiner* — Igor Kershteyn
*Assistant Examiner* — Jason Fountain
(74) *Attorney, Agent, or Firm* — James Pemrick; Hoffman Warnick LLC

(57) ABSTRACT

A cast component includes a body and a passage defined within the body. The passage includes a first portion, a second portion and a turn portion fluidly coupling the first and second portions. The turn portion includes a first surface and a second surface. A surface anti-freckling element extends through the turn portion of the passage from the first surface to the second surface of the turn portion. The element separates the passage in the turn portion into a first sub-passage and a second sub-passage. The element is formed by an opening in a removable core used during the casting that includes a surface anti-freckling opening at the location of the element that provides a path for low-density liquid alloy to flow through a core turn portion of the core to reduce surface freckling of the passage in the body of the component.

18 Claims, 8 Drawing Sheets

CAST COMPONENT INCLUDING PASSAGE HAVING SURFACE ANTI-FRECKLING ELEMENT IN TURN PORTION THEREOF, AND RELATED REMOVABLE CORE AND METHOD

TECHNICAL FIELD

The disclosure relates generally to casting components, and more particularly, to a cast component including a surface anti-freckling element in a turn portion of a passage. The element is formed by an opening in a core turn portion of a removable core used during the casting that includes an opening at the location of the element. The opening provides a path for low-density liquid alloy to flow through the core turn portion of the core to reduce surface freckling of the passage in the body of the component.

BACKGROUND

During casting of components using single crystal metal alloys, a sheet-like solidification front moves upwardly through the melt pool as the molten alloy hardens. As the solidification front moves upwardly, heavier density liquid alloy including dendrites solidifies first, and lower density liquid alloy including inter-dendrite material solidifies second. One challenge with casting single crystal metal alloys includes preventing freckling in a surface of the component. Freckling includes spotted regions of poor quality alloy including dendrite arms and/or equiaxed grains that may, depending on location, impact life expectancy of the component. Due to the impact on life expectancy, compared to the rest of the casting, freckling needs to be avoided at certain locations within high performance cast components such as superalloy turbine blades. Freckling in a surface typically occurs in large masses of material, but can also occur, for example, where a casting core restricts flow of the low-density liquid alloy as the solidification front moves upwardly in the casting.

BRIEF DESCRIPTION

An aspect of the disclosure provides a cast component comprising: a body; a passage defined within the body, the passage including a first portion, a second portion and a turn portion fluidly coupling the first portion and the second portion, the turn portion including a first surface and a second surface; and a surface anti-freckling element extending through the turn portion of the passage from the first surface to the second surface of the turn portion, the surface anti-freckling element separating the passage in the turn portion into a first sub-passage and a second sub-passage, wherein the passage is devoid of surface freckling.

Another aspect of the disclosure provides a turbine blade, comprising: a body including an airfoil, a tip and a root; a cooling passage defined within the body, the cooling passage including a first portion, a second portion and a turn portion fluidly coupling the first portion and the second portion, the turn portion including a first surface and a second surface; and a surface anti-freckling element extending through the turn portion of the cooling passage from the first surface to the second surface of the turn portion, the surface anti-freckling element separating the cooling passage in the turn portion into a first sub-passage and a second sub-passage, wherein the turn portion defines a cooling passage turn located in at least one of the tip and the root, and is devoid of surface freckling, and wherein the surface anti-freckling element is non-load bearing.

Another aspect of the disclosure provides a removable core for casting a turbine blade in a mold, the removable core comprising: a core body for defining a cooling passage in a body of the turbine blade, the core body including a first core portion, a second core portion and a core turn portion coupling the first core portion and the second core portion, the core turn portion including an inner surface and an outer surface; and a surface anti-freckling opening extending through the core turn portion from the inner surface to the outer surface of the core turn portion, the surface anti-freckling opening separating the core turn portion into a first sub-portion and a second sub-portion and providing a path for low-density liquid alloy to flow through the core turn portion during a casting process to reduce surface freckling of the cooling passage in the body of the turbine blade.

Yet another aspect of the disclosure provides a method of casting a turbine blade, comprising: forming a removable core including: a core body for defining a cooling passage in a body of the turbine blade, the core body including a first core portion, a second core portion and a core turn portion coupling the first core portion and the second core portion, the core turn portion including an inner surface and an outer surface; and a surface anti-freckling opening extending through the core turn portion from the inner surface to the outer surface of the core turn portion, the surface anti-freckling opening separating the core turn portion into a first sub-portion and a second sub-portion; placing the removable core in a mold defining an outer surface of at least a portion of the turbine blade; and casting the turbine blade in the mold, the surface anti-freckling opening providing a path for low-density liquid alloy to flow through the core turn portion to reduce surface freckling of the cooling passage in the body of the turbine blade.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
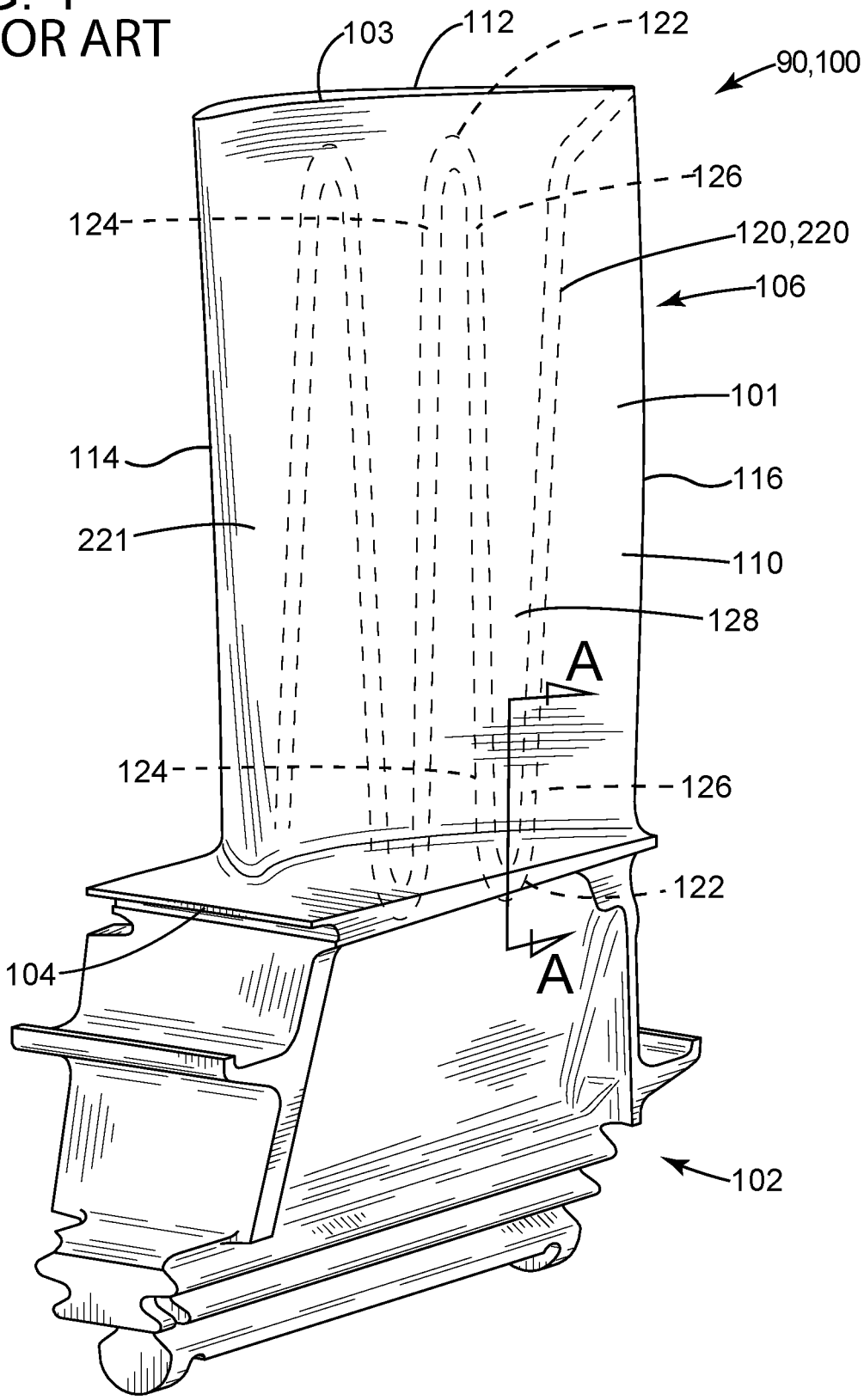
FIG. 1 PRIOR ART
FIG. 1 shows a perspective view of a cast component in the illustrative form of a turbine blade, and in which embodiments of the present disclosure may be employed.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the subject matter of the current disclosure, it will become necessary to select certain terminology when referring to and describing relevant portions within an illustrative cast component such as a turbine blade. To the extent possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

It is often required to describe parts that are disposed at differing radial positions with regard to a center axis. The term "radial" refers to movement or position perpendicular to an axis. For example, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to an axis, e.g., a turbine rotor. Finally, the term "circumferential" refers to movement or position around an axis. It will be appreciated that such terms may be applied in relation to the center axis of the turbine.

In addition, several descriptive terms may be used regularly herein, as described below. The terms "first", "second", and "third" may be used interchangeably to distinguish one component from another and are not intended to signify location or importance of the individual components.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof. "Optional" or "optionally" means that the subsequently described event or circumstance may or may not occur or that the subsequently describe component or element may or may not be present, and that the description includes instances where the event occurs or the component is present and instances where it does not or is not present.

Where an element or layer is referred to as being "on," "engaged to," "connected to" or "coupled to" another element or layer, it may be directly on, engaged to, connected to, or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

As indicated above, the disclosure provides a cast component including a body and a passage defined within the body. The passage includes a first portion, a second portion and a turn portion fluidly coupling the first and second portions. The turn portion includes a first surface and a second surface. A surface anti-freckling element extends through the turn portion of the passage from the first surface to the second surface of the turn portion. The element separates the passage in the turn portion into a first sub-passage and a second sub-passage. The element is formed by a removable core used during the casting of the component that includes a surface anti-freckling opening at the location of the element. Freckling can occur where low-density liquid alloy flows upwardly and creates plumes that include dendrite arms that can deposit and create freckles (freckle chains) on the surface of the component. Freckling can be constrained in regions of the casting where flow recirculation cannot be supported and thus the plumes cannot develop. In this case, the low-density liquid alloy can collect at the solidification front. When this layer of low-density liquid alloy encounters a restraint on flow created by a physical obstruction, such as the turnaround in a core, then the low-density liquid alloy flows along the surface of the core, creating freckles on the first surface of the turn portion of the passage. The surface anti-freckling opening according to embodiments of the disclosure provides a path for low-density liquid alloy to flow through a turn portion of the core and avoid the constrained area, thus allow the dendrite arms to reach the main melt pool. In this manner, the opening reduces surface freckling of the passage in the body of the component.

FIG. 1 shows a perspective view of an illustrative cast component 90 in the form of a turbine blade 100. Turbine blade 100 includes a body 101 including a root 102 by which turbine blade 100 attaches to a rotor of a turbine (not shown). Root 102 may include a dovetail configured for mounting in a corresponding dovetail slot in the perimeter of a rotor disc. Root 102 may further include a shank that extends between the dovetail and a platform 104, which is disposed at the junction of airfoil 106 and root 102 and defines a portion of the inboard boundary of the flow path through a turbine. It will be appreciated that airfoil 106 is the active component of turbine blade 100 that intercepts the flow of working fluid and induces the rotor disc to rotate. Airfoil 106 extends from root 102 to a tip 103. It will be seen that airfoil 106 of turbine blade 100 includes a concave pressure side (PS) outer wall 110 and a circumferentially or laterally opposite convex suction side (SS) outer wall 112 extending axially between opposite leading and trailing edges 114, 116 respectively. Outer walls 110 and 112 also extend in the radial direction from platform 104 to outboard tip 103.

As illustrated, cast component 90 such as turbine blade 100 may also include a passage 120 therein that passes, for example, in a sinusoidal manner through airfoil 106. Passage 120 may be a coolant passage that delivers a coolant throughout turbine blade 100, and may accordingly may be referenced herein as a passage or a cooling passage. As illustrated, passage 120 may include any number of turn portions 122 in root 102 and/or tip 103. Turn portions 122 couple respective first and second portions 124, 126 of passage 120 on opposing sides of turn portions 122. First and second portions 124, 126 may be referred to as 'uptubes' as they extend radially in turbine blade 100. A rib 128 separates various portions 124, 126 of passage 120. While turbine blade 100 of this example is a turbine rotor blade, it will be appreciated that the present disclosure also may be applied to other types of blades and/or hot gas path components within a turbine, including, for example, turbine stationary blades, nozzles or vanes, or casing components. In addition, while the disclosure will be described relative to turbine blade 100, embodiments of the disclosure may be applied to any cast component 90 in which freckling on a surface of the component is a concern.

Cast component 90 (hereafter "component 90") is made of a single crystal metal or metal alloy, such as a superalloy or columnar grain structures (e.g., directionally solidified (DS) blades). In one embodiment, component 90 may be made of a metal which may include a pure metal or an alloy. As used herein, "superalloy" refers to an alloy having numerous excellent physical characteristics compared to conventional alloys, such as but not limited to: high mechanical strength, high thermal creep deformation resistance, like Rene N5, Rene N500, Rene 108, CM247, Haynes alloys, Incalloy, MP98T, TMS alloys, CMSX single crystal alloys. In one embodiment, superalloys, for which teachings of the disclosure may be especially advantageous, are those superalloys having a high gamma prime (γ') value. "Gamma prime" (γ') is the primary strengthening phase in nickel-based alloys. Example high gamma prime superalloys include but are not limited to: Rene 108, N4, N5, N500, GTD 444, MarM 247 and IN 738. In one particular embodiment, component 90 may include Rene N4.

Figure 3:
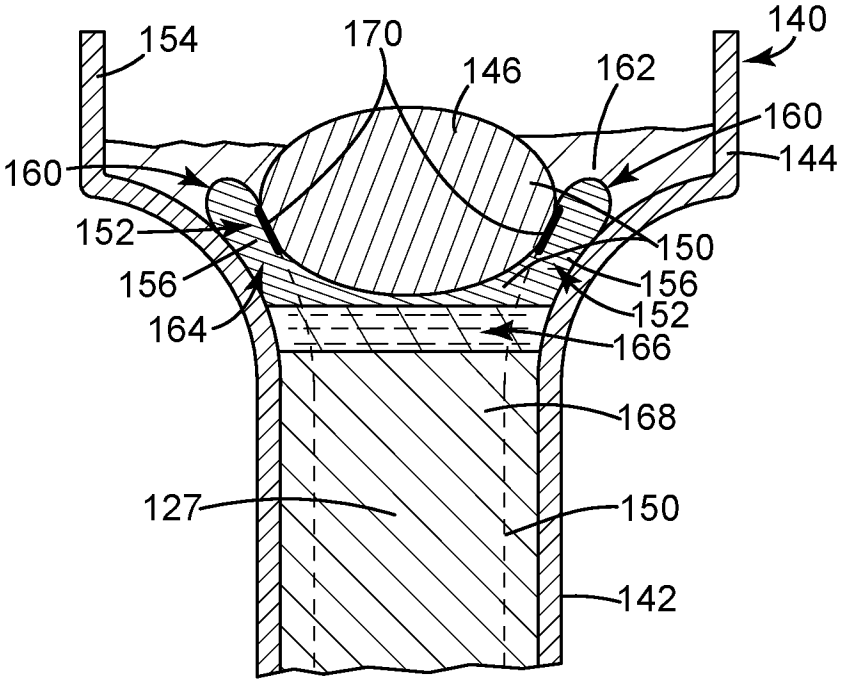
FIG. 3 PRIOR ART
FIG. 3 shows a schematic cross-sectional view along line A-A in FIG. 1 of a portion of a component being cast upside down, according to the prior art.
Figure 2:
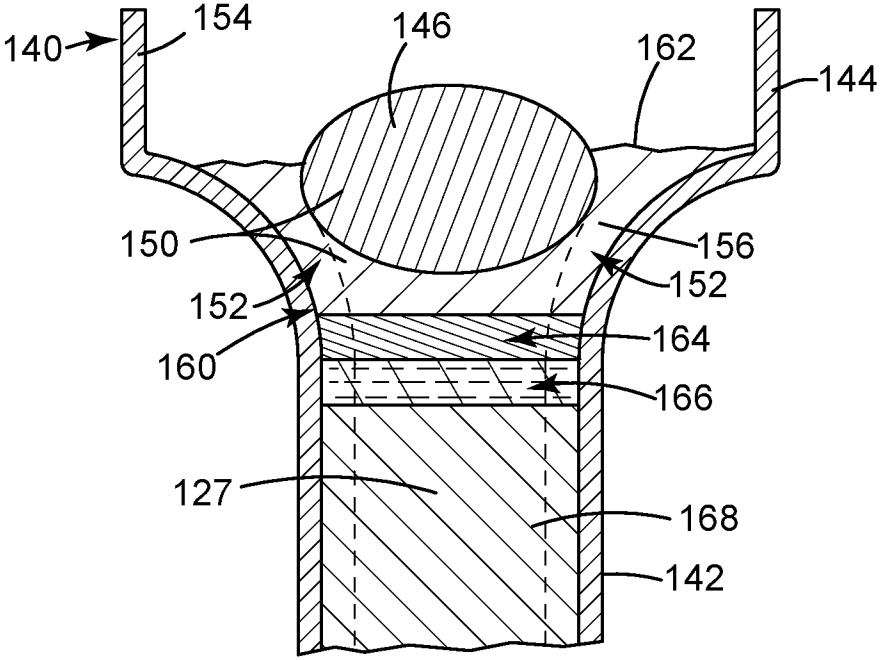
FIG. 2 PRIOR ART
FIG. 2 shows a schematic cross-sectional view along line A-A in FIG. 1 of a portion of a component being cast upside down, according to the prior art.

FIGS. 2 and 3 show schematic cross-sectional views of a portion of a turbine blade being cast upside down, according to the prior art. FIGS. 2 and 3 are taken along view line A-A in FIG. 1 as turbine blade 100 is cast. FIGS. 2 and 3 show a portion of mold 140 where an airfoil-forming portion 142 meets a platform-forming portion 144, and a removable core 146 is positioned to form cooling passage 120 (FIG. 1) in the illustrative turbine airfoil 106. Removable core 146 extends through airfoil-forming portion 142 of mold 140 and includes a core turn portion 150. In FIGS. 2 and 3, core turn portion 150 would extend out of the page. In one non-limiting example, core turn portion 150 may be a U-shaped turnaround in passage 120 of turbine blade 100 (FIG. 1) that couples portions 124, 126 (uptubes) of passage 120. It is emphasized, however, that core turn portion 150 may be any portion of a removable core 146 that restrains the advancement of a solidification front 160. Hence, a constrained area 152 may include a section of the casting in which flow recirculation and freckle plumes cannot develop within solidifying zone 166. Examples may include a rib cavity 127 (between portions of core 146 in FIGS. 2-3) in which rib 128 (FIG. 4) is formed separating first and second portions 124, 126 (uptubes) of cooling passage 120, and a space 156 between core 146 and inner surface 154 of mold 140 that is thinner than at adjacent areas to create a thinner wall in the cast component. As understood by those with skill in the art, constrained areas 152 may be created in a variety of alternative situations.

As shown in FIG. 2, as casting occurs, a solidification front 160 is created below a main liquid melt pool 162 of liquid alloy (mold shown partially filled). As noted, during dendritic growth in solidifying zone 166, heavy elements segregate preferentially to dendrite structures of solidified metal alloy 168, leaving behind low-density liquid alloy 164 in spaces between dendrites. Low-density liquid alloy 164 migrates upward due to buoyancy. When the velocity of solidification front 160 is lower than the velocity of low-density liquid alloy 164 upward, then the casting is susceptible to freckling. In constrained areas 152, the recirculation paths required for freckle plumes cannot develop. Instead, low-density liquid alloy 164 accumulates above solidifying zone 166, creating a layer of low-density liquid alloy 164. Low-density liquid alloy 164 can include dendrite fragments accumulated during the upward flow of the alloy.

As shown in FIG. 3, when the layer of low-density liquid alloy 164 encounters restraint in flow such as core turn portion 150, it is forced to flow around the obstruction and can deposit dendrite fragments or nucleate small equiaxed grains on the surface of removable core 146 to create freckle chains 170 on one or both surfaces of passage 120 (FIG. 1).

Figure 4:
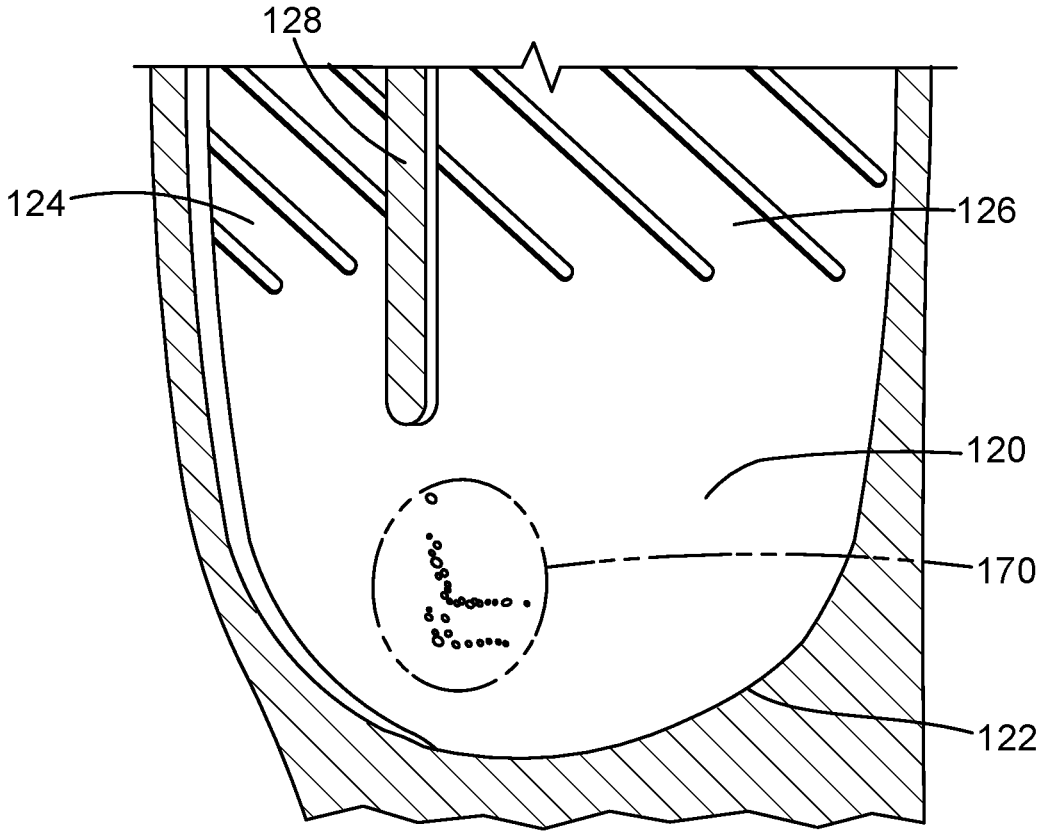
FIG. 4 PRIOR ART
FIG. 4 shows an enlarged cross-sectional view of a turn portion in a passage of a component including a freckle chain, according to the prior art.

Once casting is complete, removable core 146 may be removed using any now known or later developed removal process, e.g., leaching. FIG. 4 shows an enlarged view of turn portion 122 with removable core 146 already removed and illustrating a freckle chain 170 between first and second portions 124, 126 of cooling passage 120. Rib 128 separates portions 124, 126.

Figure 6:
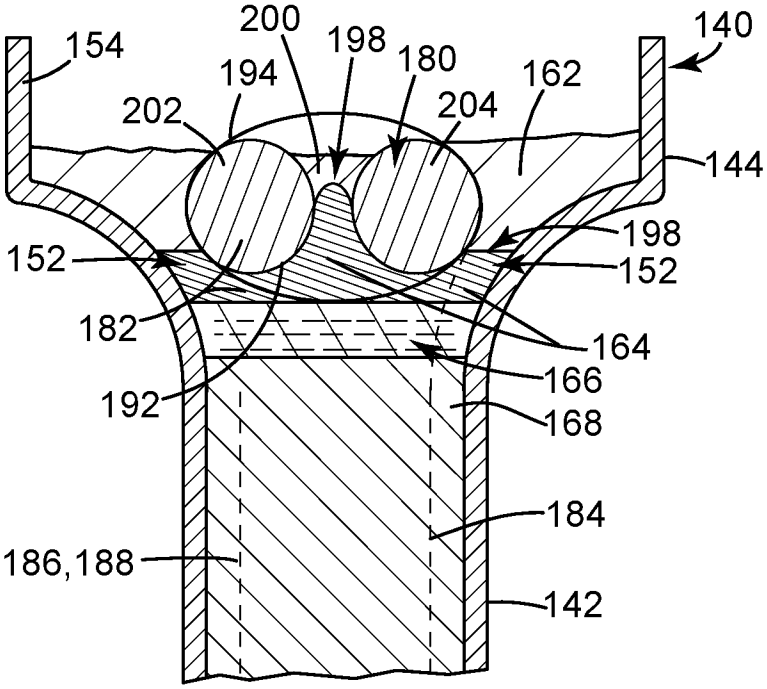
FIG. 6 shows a schematic cross-sectional view along line A-A in FIG. 1 of a portion of a component being cast upside down using a removable core including a surface anti-freckling opening, according to embodiments of the disclosure.
Figure 5:
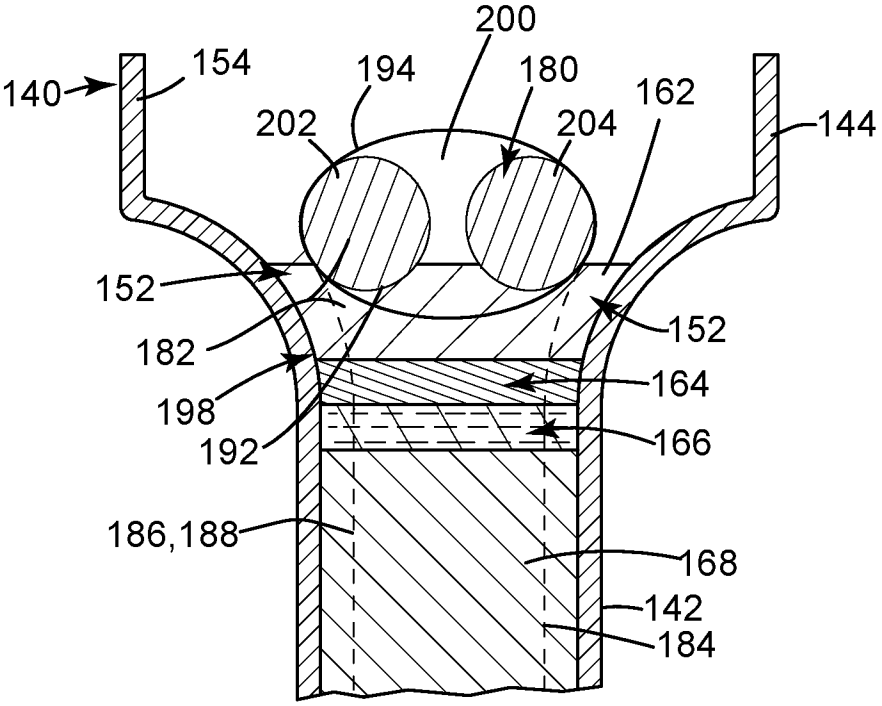
FIG. 5 shows a schematic cross-sectional view along line A-A in FIG. 1 of a portion of a component being cast upside down using a removable core including a surface anti-freckling opening, according to embodiments of the disclosure.
Figure 7:
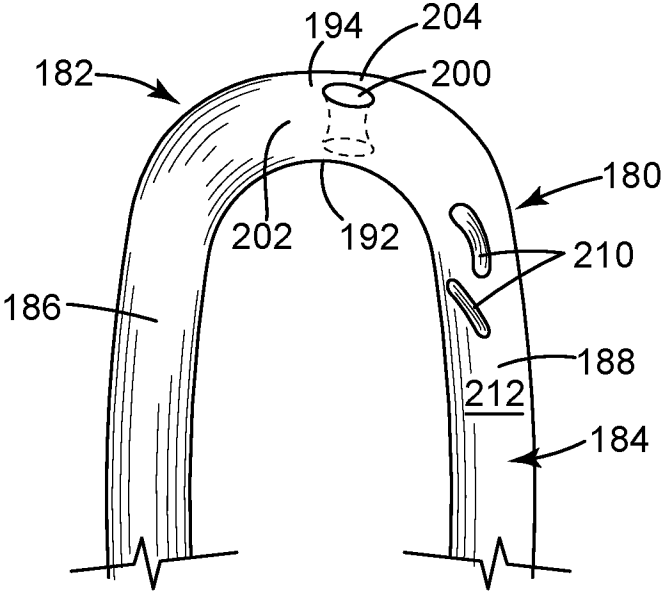
FIG. 7 shows a perspective view of a core turn portion of a removable core, according to embodiments of the disclosure.

FIGS. 5-6 show schematic cross-sectional views of a portion of turbine blade 100 (FIG. 1) being cast upside down using a removable core 180, according to embodiments of the disclosure. FIGS. 5 and 6 are taken along view line A-A in FIG. 1 as turbine blade 100 is cast. FIG. 7 shows a perspective view of a core turn portion 182 of removable core 180. Removable core 180 for casting turbine blade 100 in mold 140 may include a core body 184 for defining cooling passage 120 (FIG. 1) in body 101 (FIG. 1) of turbine blade 100. Core body 184 includes a first core portion 186, a second core portion 188 and core turn portion 182 coupling first core portion 186 and second core portion 188. Core turn portion 182 includes an inner surface 192 and an outer surface 194. In one non-limiting example, core turn portion 182 may be used to form a U-shaped turnaround in cooling passage 120 (FIG. 1) of turbine blade 100 (FIG. 1) that couples portions 124, 126 (uptubes) (FIG. 1) of the passage. It is emphasized, however, that core turn portion 182 may be any portion of removable core 180 that restrains the advancement of a solidification front 160, creating a constrained area 152. In this non-limiting example, as illustrated, inner surface 192 of core turn portion 182 creates a restraint to a solidification front 198 advancing upward through rib cavity 127 (to create rib 128) within body 101 (FIG. 1) of turbine blade 100. In contrast to conventional cores, removable core 180 includes a surface anti-freckling opening 200 extending through core turn portion 182 from inner surface 192 to outer surface 194 of core turn portion 182. Surface anti-freckling opening 200 (hereinafter "opening 200") separates core turn portion 182 into a first sub-portion 202 and a second sub-portion 204

As shown in FIG. 5, as casting occurs, solidification front 198 is created below main liquid melt pool 162 of liquid alloy with low-density liquid alloy 164 over solidifying (mushy) zone 166 over a solidified metal alloy 168 (mold shown partially filled). As noted previously, during dendritic growth in solidifying zone 166, heavy elements segregate preferentially to dendrite structures of solidified metal alloy 168, leaving behind low-density liquid alloy 164 in spaces between dendrites. As shown in FIG. 6, low-density liquid alloy 164 migrates upwardly due to buoyancy and accumulates at front 198. In contrast to conventional cores, opening 200 provides a path for low-density liquid alloy 164 to flow through core turn portion 182 during the casting process to reduce surface freckling of cooling passage 120 in body 101 of turbine blade 100.

Opening 200 can have any shape desired to reduce flow resistance for the particular core-mold configuration. In one embodiment, shown in FIGS. 5-6, opening 200 has an hourglass cross-section. In other embodiments, opening 200 may be cylindrical, frustoconical, etc. Opening 200 may have a smooth surface or a rough surface. As shown in FIG. 7, removable core 180 may also optionally include at least one surface anti-freckling trench 210 on a surface 212 of core turn portion 182. Trenches 210 may be provided, where desired, to provide additional low-density liquid alloy 'traps' where dendrite arms can settle rather than areas where freckle chains are not desired. Trench(es) 210 can be positioned in any location desired, and have any depth, length or shape. Notably, trench(es) 210 can have a shape to form any desired shape turbulator for cooling passage 120.

Figure 8:
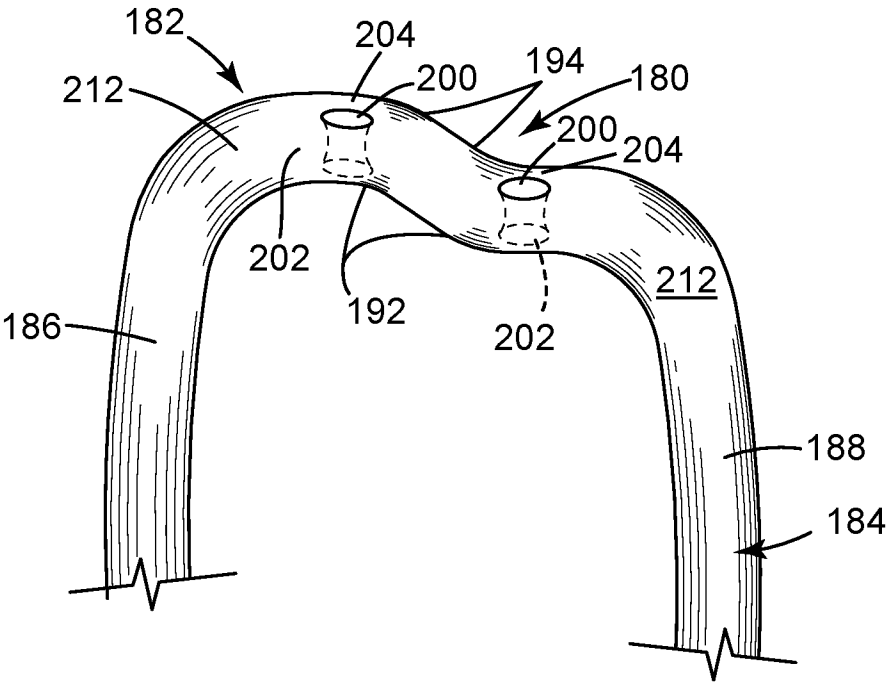
FIG. 8 shows a perspective view of a core turn portion of a removable core, according to other embodiments of the disclosure.

Opening 200 may be provided in more than one location. For example, openings 200 can be provided on removable core 180 wherever decreased resistance to flow for low-density liquid alloy 164 is desired. FIG. 8 shows another embodiment in which two or more surface anti-freckling openings 200 are employed.

Returning to FIGS. 5 and 6, a method of casting turbine blade 100 (FIG. 1) may include forming removable core 180 including core body 184 for defining passage 120 in body 101 of component 90, e.g., a cooling passage in turbine blade 100. Removable core 180 may include any now known or later developed removable core material such as but not limited to ceramics, etc., and may be made using any technology, e.g., additive manufacture, etc. Core body 184 includes first core portion 186, second core portion 188, and core turn portion 182 coupling the first core portion and the second core portion. Core turn portion 182 includes inner surface 192 and outer surface 194. As noted, removable core 180 also includes surface anti-freckling opening 200 extending through core turn portion 182 from inner surface 192 to outer surface 194 of core turn portion 182. Opening 200 separates core turn portion 182 into first sub-portion 202 and second sub-portion 204. The method may include placing removable core 180 in mold 140 defining an outer surface 221 (FIG. 1) of at least a portion of component 90, e.g., turbine blade 100. Removable core 180 can be placed in mold 140 in any now known or later developed manner.

The method may also include, as shown in FIGS. 5-6, casting turbine blade 100 (FIG. 1) in mold 140. During the casting, surface anti-freckling opening 200 provides a path for low-density liquid alloy 164 to flow through core turn portion 180 to reduce surface freckling of passage 120 in body 102 of component 90, e.g., cooling passage of turbine blade 100. Here, as shown in FIG. 6, low-density liquid alloy 164 accumulates at solidification front 198, but flows through opening 200 in removable core 180 and is incorporated back into the bulk of main liquid melt pool 162. After removal of core, the remaining metal creates a surface anti-freckling element 240 (FIGS. 9-12) that may act as a non-loading bearing turbulator. Where trenches 210 are provided on surface 212 of core 180, they can also capture low-density liquid alloy 164 and act as freckle traps, which eventually provide turbulator ribs 250 (FIG. 11).

Figure 9:
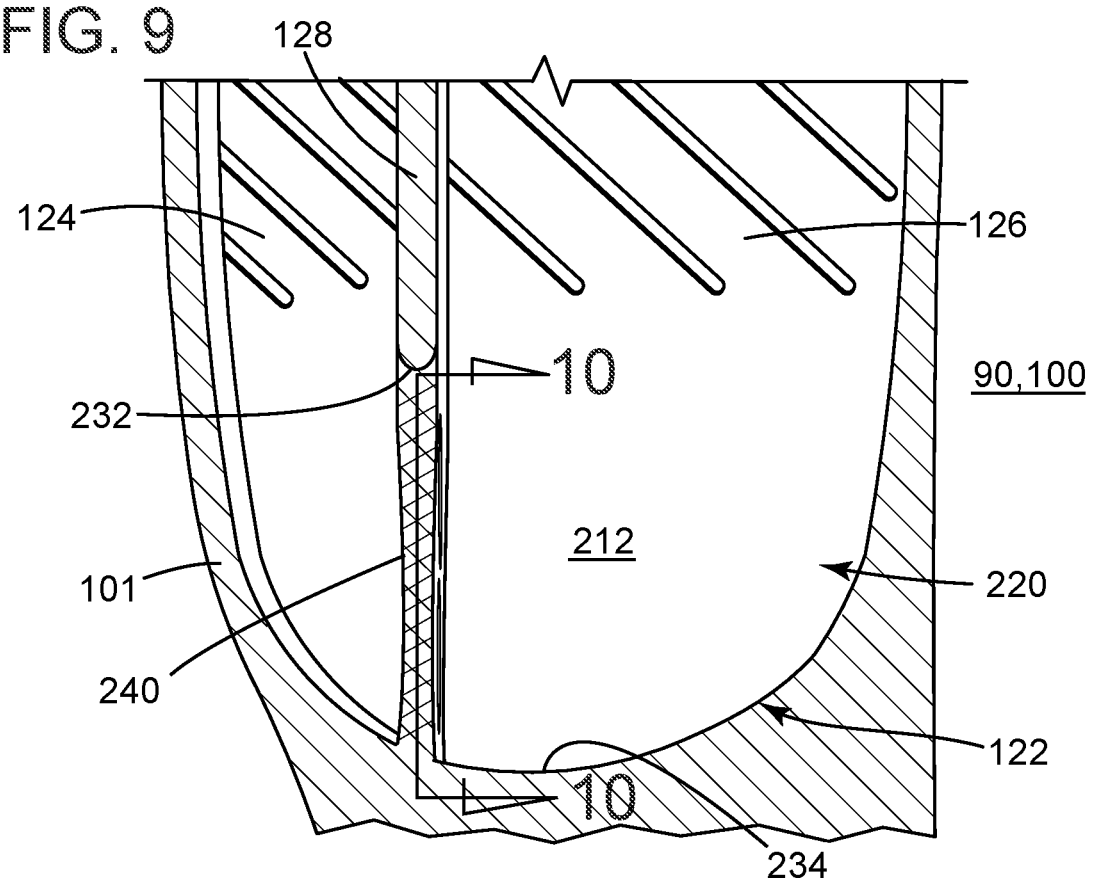
FIG. 9 shows an enlarged cross-sectional view of a turn portion in a passage of a cast component including a surface anti-freckling element formed according to embodiments of the disclosure, and devoid of a freckle chain.
Figure 10:
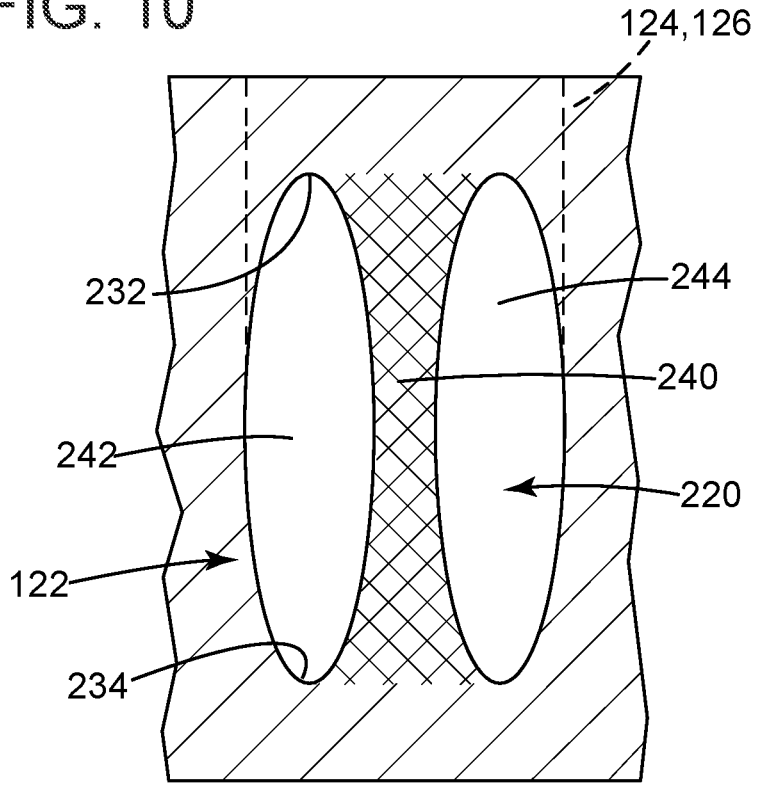
FIG. 10 shows a cross-sectional view of a turn portion in a passage of a cast component along view line 10-10 in FIG. 9.

FIGS. 1 and 9 illustrate cast component 90, according to embodiments of the disclosure. FIG. 9 shows an enlarged cross-sectional view of turn portion 122 in passage 220 of cast component 90 formed according to embodiments of the disclosure. Passage 220, i.e., a surface thereof, is devoid of a freckle chain. Cast component 90 may include body 101, and passage 220 is defined within the body. As shown best in FIG. 9, passage 220 includes first portion 124, second portion 126 and turn portion 122 fluidly coupling first portion 124 and second portion 126. Turn portion 122 of passage 120 may have a variety of shapes, e.g., a curved shape such as a U-shape. FIG. 10 shows a cross-sectional view of turn portion 122 of passage 220, along view line 10-10 in FIG. 9. As illustrated, turn portion 122 includes a first surface 232 (FIGS. 9 and 10) and an opposing, second surface 234 (FIGS. 9 and 10).

Cast component 90 also includes surface anti-freckling element 240 extending through turn portion 122 of passage 220 from first surface 232 to second surface 234 of turn portion 122. Surface anti-freckling element 240 is formed by opening 200 (FIG. 6) in removable core 180 (FIG. 6). Surface anti-freckling element 240 (hereafter "element 240") separates passage 120 in turn portion 122 into a first sub-passage 242 and a second sub-passage 244. As noted, passage 120 is devoid of surface freckling. Element 240 may have any cross-section created by opening 200 (FIG. 6). For example, as shown in FIG. 10, element 240 may have an hourglass cross-section. In other embodiments, it may be cylindrical, frustoconical, etc. Element 240 may also have a smooth surface or a rough surface, e.g., depending on the desired impact of coolant flow. Body 101 includes a homogenous, single crystal metal, which may include any of the materials previously list herein, or any columnar microstructures such as directionally solidified (DS) blades. (With regard to directional solidification, when a casting is directionally solidified, the microstructure is columnar, with a primary crystal orientation in the direction of the temperature gradient. When a seed selector and/or seed is added to the base of the casting, a single crystal structure is produced. Both types of castings are susceptible to freckling). Body 101 has a first porosity. However, due to the accumulation of dendrite arms in opening 200 (FIG. 6) during casting, element 240 may include at least one of equiaxed grains and a second porosity greater than the first porosity. That is, element 240 may include the poorer quality metal alloy. Accordingly, surface anti-freckling element 240 may be designed as non-load bearing. As described, body 101 may define turbine blade 100 (FIG. 1) including tip 103 and root 102. Turn portion 122 may define a cooling passage 120 turn located in tip 103 and/or root 102.

Figure 11:
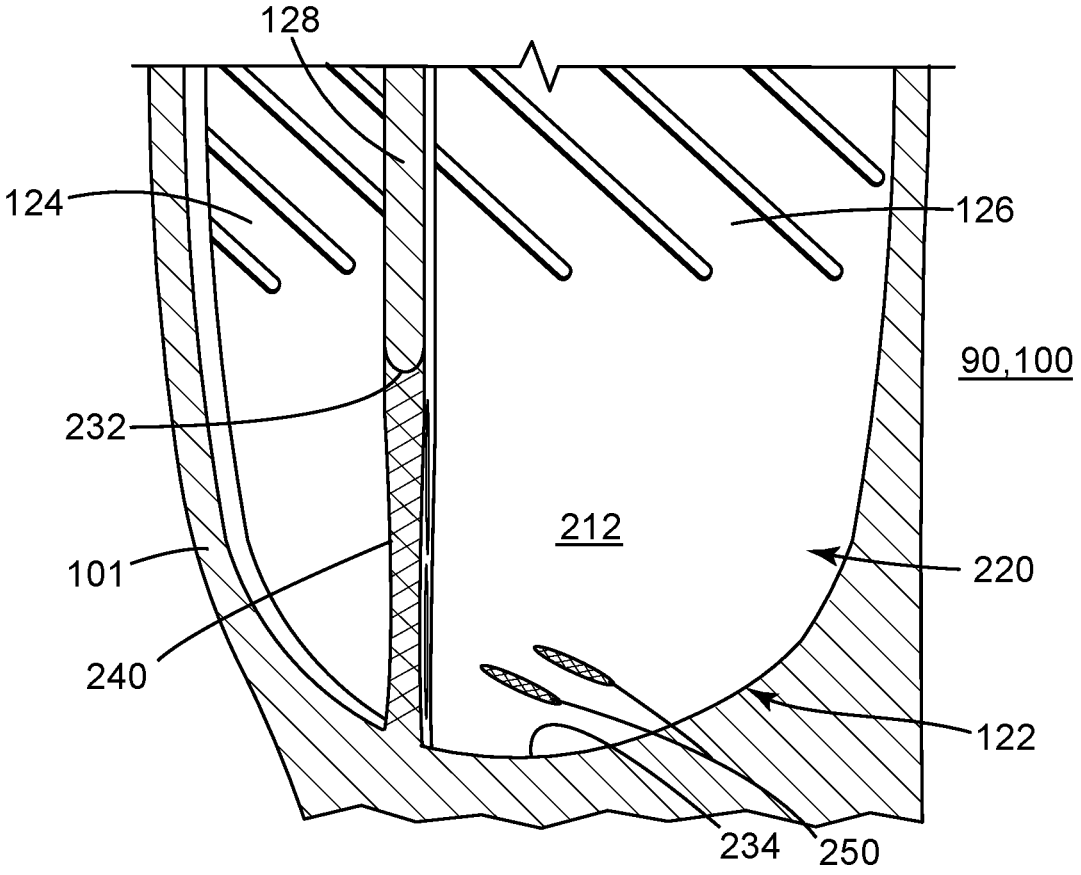
FIG. 11 shows a cross-sectional view of a turn portion in a passage of a cast component including a surface anti-freckling element and ribs formed according to embodiments of the disclosure, and devoid of a freckle chain.

FIG. 11 shows an enlarged cross-sectional view of a turn portion 122 in passage 220 of cast component 90 formed according to other embodiments of the disclosure. In these embodiments, at least one surface anti-freckling (turbulator) rib 250 may be provided on first and/or second surfaces 232, 234 of turn portion 122. Rib(s) 250 may be formed by trenches 210 on removable core (FIG. 7), and may provide any desired turbulator shape. Any number of ribs/trenches can be provided.

Figure 12:
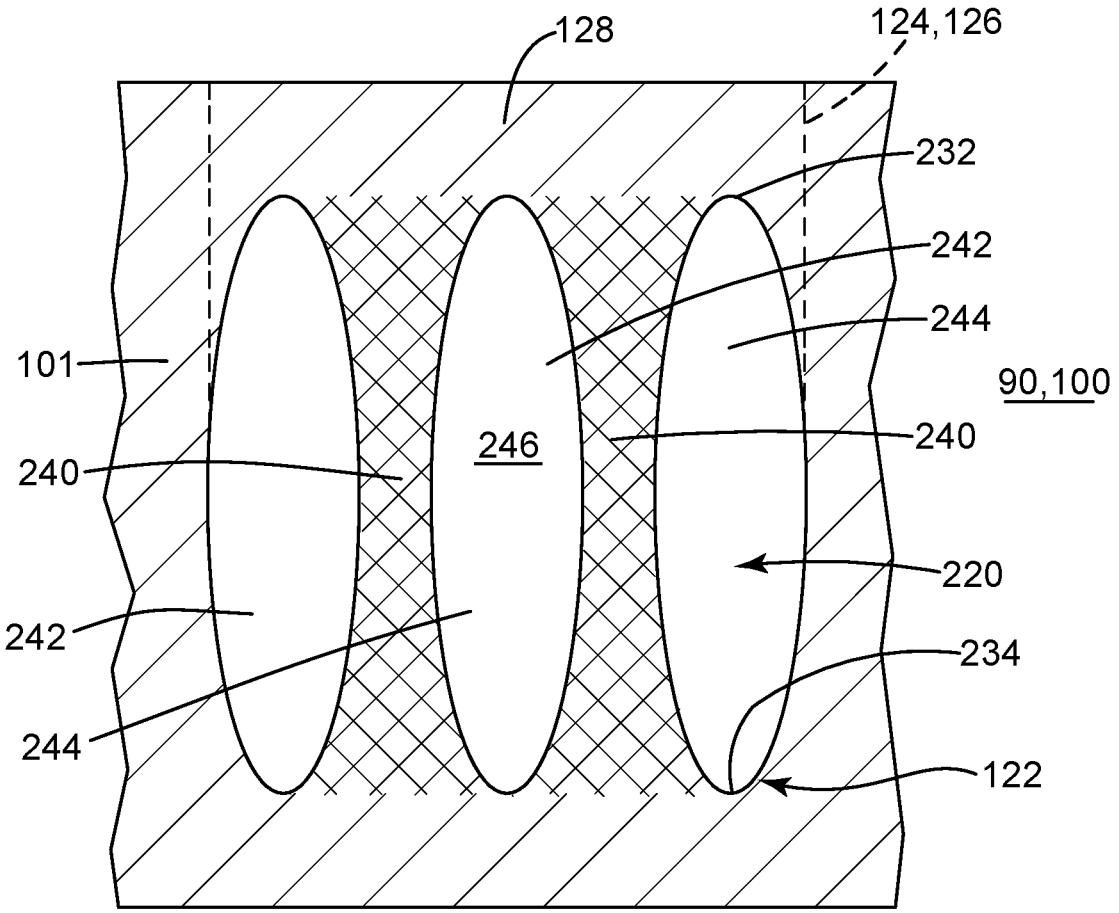
FIG. 12 shows an enlarged cross-sectional view of a turn portion in a passage of a cast component including two or more surface anti-freckling elements formed according to embodiments of the disclosure, and devoid of a freckle chain.

FIG. 12 shows an enlarged cross-sectional view of a turn portion 122 in passage 220 of cast component 90 formed according to yet other embodiments of the disclosure. In these embodiments, two or more surface anti-freckling elements 240 may be provided. Each element 240 separates passage 120 in turn portion 122 into respective first sub-passages 242 and second sub-passage 244. As shown, first and second sub-passages 242, 244 are fluidly coupled (sub-passage 246) between adjacent pairs of the two or more surface anti-freckling element 240.

As noted, component 90 may take the form of turbine blade 100. In this case, as noted, body 101 includes airfoil 106, tip 103 and root 102. Cooling passage 120 is defined within body 102, and includes first portion 124, second portion 126 and turn portion 122 fluidly coupling first portion 124 and second portion 126. Element(s) 240 extend through turn portion 122 of cooling passage 120 from first surface 232 to second surface 234 of the turn portion. Each element 240 separates cooling passage 120 in turn portion 122 into first sub-passage 242 and second sub-passage 244. Sub-passages 242, 244 are fluidly coupled between adjacent pairs of the two or more surface anti-freckling elements 240. Turn portion 122 may define a cooling passage turn located in tip 103 and/or root 102. In any event, turn portion 122 is devoid of surface freckling. Element(s) 240 may be non-load bearing. Turbine blade 100 may also include rib(s) 250 on surface(s) 232, 234 of turn portion 122. Element(s) 240 and/or rib(s) 250 can act as turbulators for coolant passing through cooling passage 120.

Embodiments of the disclosure provide a removable core and casting method that reduces freckling in cast components where constrained areas exist, such as root and/or tip turns in cooling passages of, for example, a hot gas path component such as a turbine blade or nozzle. The removable core can include surface anti-freckling opening and/or freckle trap ribs, which then form turbulators or other structures. The opening(s) and/or rib(s) act to collect the low-density liquid alloy and trap the freckles in a region of the component that does not impact life expectancy of the component and may not be load bearing.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately," as applied to a particular value of a range, applies to both end values and, unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application and to enable others of ordinary skill in the art to understand the disclosure for various embodiments with various modifications as are suited to the particular use contemplated.

What is claimed is:

1. A cast component, comprising:

a body;

a passage defined within the body, the passage including a first portion, a second portion, and a turn portion fluidly coupling the first portion and the second portion, the turn portion including a first surface and a second surface; and a surface anti-freckling element extending through the turn portion of the passage from the first surface to the second surface of the turn portion, the surface anti-freckling element separating the passage in the turn portion into a first sub-passage and a second sub-passage, wherein the passage is devoid of surface freckling, and wherein the surface anti-freckling element includes two or more surface anti-freckling elements, each surface anti-freckling element separating the passage in the turn portion into the first sub-passage and the second sub-passage, wherein the first and second sub-passages are fluidly coupled between adjacent pairs of the two or more surface anti-freckling elements.

2. The cast component of claim 1, wherein at least one of the two or more surface anti-freckling elements has an hourglass cross-section.

3. The cast component of claim 1, wherein the body includes a homogenous, single crystal metal having a first porosity, and at least one of the two or more surface anti-freckling elements includes at least one of equiaxed grains and a second porosity greater than the first porosity.

4. The cast component of claim 1, wherein the turn portion of the passage has a U-shape.

5. The cast component of claim 1, wherein the body defines a turbine blade including a tip and a root, and the turn portion defines a cooling passage turn located in at least one of the tip and the root.

6. The cast component of claim 1, further comprising at least one surface anti-freckling rib on the first surface of the turn portion.

7. The cast component of claim 1, wherein at least one of the two or more surface anti-freckling elements is non-load bearing.

8. A turbine blade, comprising:

a body including an airfoil, a tip and a root;

a cooling passage defined within the body, the cooling passage including a first portion, a second portion, and a turn portion fluidly coupling the first portion and the second portion, the turn portion including a first surface and a second surface; and a surface anti-freckling element extending through the turn portion of the cooling passage from the first surface to the second surface of the turn portion, the surface anti-freckling element separating the cooling passage in the turn portion into a first sub-passage and a second sub-passage, wherein the turn portion defines a cooling passage turn located in at least one of the tip and the root, and is devoid of surface freckling, and wherein the surface anti-freckling element is non-load bearing, wherein the surface anti-freckling element includes two or more surface anti-freckling elements, each surface anti-freckling element separating the cooling passage in the turn portion into the first sub-passage and the second sub-passage, wherein the first and second sub-passages are fluidly coupled between adjacent pairs of the two or more surface anti-freckling elements.

9. The turbine blade of claim 8, wherein at least one of the two or more surface anti-freckling elements has an hourglass cross-section.

10. The turbine blade of claim 8, wherein the body includes a homogenous, single crystal metal having a first porosity, and at least one of the two or more surface anti-freckling elements includes at least one of equiaxed grains and a second porosity greater than the first porosity.

11. The turbine blade of claim 8, wherein the turn portion of the cooling passage has a U-shape.

12. The turbine blade of claim 8, further comprising at least one surface anti-freckling rib on the first surface of the turn portion.

13. The turbine blade of claim 8, wherein the body includes a superalloy.

14. The turbine blade of claim 8, wherein at least one of the two or more surface anti-freckling elements is non-load bearing.

15. A removable core for casting a turbine blade in a mold, the removable core comprising:

a core body for defining a cooling passage in a body of the turbine blade, the core body including a first core portion, a second core portion and a core turn portion coupling the first core portion and the second core portion, the core turn portion including an inner surface and an outer surface; and a surface anti-freckling opening extending through the core turn portion from the inner surface to the outer surface of the core turn portion, the surface anti-freckling opening includes two or more surface anti-freckling openings separating the core turn portion into a first sub-portion and a second sub-portion and providing a path for low-density liquid alloy to flow through the core turn portion during a casting process to reduce surface freckling of the cooling passage in the body of the turbine blade.

16. The removable core of claim 15, wherein at least one of the two or more surface anti-freckling openings has an hourglass cross-section.

17. The removable core of claim 15, wherein the core turn portion of the cooling passage has a U-shape.

18. The removable core of claim 15, further comprising at least one surface anti-freckling trench on a surface of the core turn portion.

* * * * *